US011090931B2

(12) United States Patent
Henmi

(10) Patent No.: US 11,090,931 B2
(45) Date of Patent: Aug. 17, 2021

(54) IMAGE FORMING APPARATUS

(71) Applicant: Oki Electric Industry Co., Ltd., Tokyo (JP)

(72) Inventor: Yusuke Henmi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 16/720,178

(22) Filed: Dec. 19, 2019

(65) Prior Publication Data

US 2020/0247118 A1 Aug. 6, 2020

(30) Foreign Application Priority Data

Feb. 6, 2019 (JP) ..... JP2019-019484

(51) Int. Cl.

| | |
|---|---|
| ***B41J 2/125*** | (2006.01) |
| ***B41J 2/21*** | (2006.01) |
| ***B41J 2/12*** | (2006.01) |
| ***B41J 11/00*** | (2006.01) |

(52) U.S. Cl.

CPC ..... *B41J 2/125* (2013.01); *B41J 2/12* (2013.01); *B41J 2/2146* (2013.01); *B41J 11/0095* (2013.01)

(58) Field of Classification Search

None

See application file for complete search history.

(56) References Cited

U.S. PATENT DOCUMENTS 8,529,012 B2 * 9/2013 Yorimoto ..... B41J 29/38 347/19

9,162,451 B2 10/2015 Yorimoto et al.

FOREIGN PATENT DOCUMENTS

JP 2014-111326 A 6/2014

* cited by examiner

*Primary Examiner* — Alejandro Valencia

(74) *Attorney, Agent, or Firm* — Muncy, Geissler, Olds & Lowe, P.C.

(57) ABSTRACT

An image forming apparatus includes (a) recording heads, (b) an optical detection part that emits light, receives reflected light reflected on a recording medium, and generates a sensor output in correspondence with the reflected light, (c) a medium information acquisition processing part that sets a pattern image formation position where a test pattern image is formed on the recording medium based on reflection characteristics, the reflection characteristics being obtained from the sensor output of the optical detection part, (d) a pattern image formation processing part that forms the test pattern image at the pattern image formation position using the recording heads, (e) a pattern image detection processing part that detects the test pattern image at the pattern image formation position using the optical detection part, generating a detection result, and (f) an image forming condition setting part that sets an image forming condition based on the detection result.

13 Claims, 7 Drawing Sheets

IMAGE FORMING APPARATUS

TECHNICAL FIELD

This invention relates to an image forming apparatus.

BACKGROUND

Conventionally, in an image forming apparatus such as a printer, copier, facsimile machine, or multifunction peripheral, for example in an inkjet printer, printing is performed by having a carriage reciprocate along a rail, a recording medium carried, and inks ejected from recording heads mounted on the carriage and adhere to the recording medium, thereby forming an image.

In this kind of inkjet printer, in order to form an image, dots need to be formed in the same position between the outbound and inbound travels of the carriage. For that purpose, an image of a test pattern, that is, a pattern image is formed on the recording medium, the pattern image is detected by an optical sensor, and timing to eject inks from the recording heads is adjusted based on a sensor output of the optical sensor that is a detection result of the pattern image.

In this case, reflected light of light emitted toward the pattern image from a light emitting part of the optical sensor is received on a light receiving part of the optical sensor, and based on a detection voltage as the sensor output generated by the light receiving part, a correction value for adjusting the timing to eject inks is calculated.

RELATED ART

[Patent Doc.] JP Laid-Open Patent Application Publication 2014-111326

However, in the above-mentioned conventional printer including a inkjet printer, when the reflection characteristic of the recording surface of the recording medium varies by position, if the pattern image is formed on a boundary between mutually different reflection characteristics, the sensor output of the optical sensor varies at the boundary of reflection characteristics, therefore the pattern image cannot be accurately detected.

Therefore, the timing to eject developer, which is inks or tonner, from the recording heads cannot be accurately adjusted, degrading the image quality.

The objective of this invention is to solve the above-mentioned problem of the conventional printer and thereby offer an image forming apparatus that can accurately detect the test pattern image and accurately adjust the timing to eject the developer from the recording heads, improving the image quality.

SUMMARY

Following the objective above, the embodiment(s) of the invention comprises as follows.

An image forming apparatus, disclosed in the application, includes (a) recording heads that are mounted on a carriage, (b) an optical detection part that emits light onto a recording medium, receives reflected light that is the light reflected on a recording surface of the recording medium, and generates a sensor output in correspondence with the reflected light, (c) a medium information acquisition processing part that sets a pattern image formation position where a test pattern image is formed on the recording medium based on reflection characteristics of the recording surface of the recording medium, the reflection characteristics being obtained from the sensor output of the optical detection part, (d) a pattern image formation processing part that forms the test pattern image at the pattern image formation position using the recording heads, (e) a pattern image detection processing part that detects the test pattern image formed at the pattern image formation position using the optical detection part, generating a detection result, and (f) an image forming condition setting part that sets an image forming condition based on the detection result of the test pattern image by the pattern image detection processing part.

According to an embodiment of this invention, the reflection characteristic of the recording surface of a recording medium is acquired based on a sensor output of an optical detection part, pattern image formation positions are set based on the acquired reflection characteristic, and a test pattern image is formed in the set pattern image formation position, thereby the test pattern image is never formed on a boundary of reflection characteristics. Putting it another way, the test pattern image is never formed as straddling the boundary.

Therefore, because the sensor output of the optical detection part never changes at the boundary of reflection characteristics, the test pattern image can be accurately detected.

As a result, timing to eject inks from recording heads can be accurately adjusted, allowing to improve the image quality.

DETAILED DESCRIPTION OF THE PREFERRED EMBODIMENT(S)

Below, detailed explanations are given on an embodiment of this invention referring to drawings. In this case, the explanations are given on an inkjet printer as an image forming apparatus.

Figure 2:
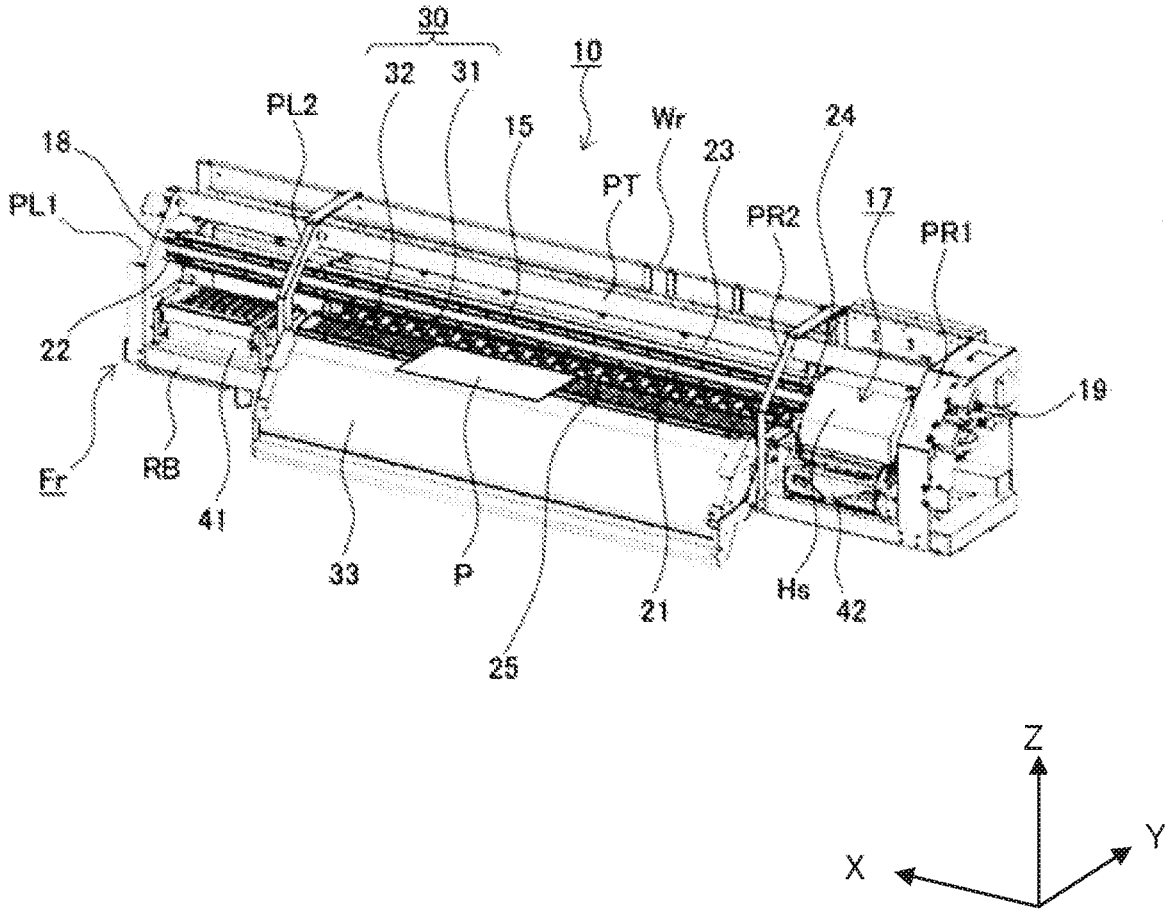
FIG. 2 is a perspective view showing the main part of the inkjet printer in the embodiment of this invention.

FIG. 2 is a perspective view showing the main part of the inkjet printer in the embodiment of this invention.

In the figure, indicated as 10 is the inkjet printer, Fr is a frame of the inkjet printer 10.

The frame Fr is provided with a receiving plate RB arranged extending from the left end to the right end when the main body of the inkjet printer 10, that is, the apparatus main body is viewed from its front side (front side in the figure), a side plate PL1 as a first main frame formed standing up from the left end of the receiving plate RB, a side plate PR1 as a second main frame formed standing up from the right end of the receiving plate RB, a frame body PL2 as a first sub frame formed standing up from the receiving plate RB at a prescribed rightward distance from the side plate PL1, a frame body PR2 as a second sub frame formed standing up from the receiving plate RB at a prescribed leftward distance from the side plate PR1, a rear wall Wr that connects the side plates PL1 and PR1 and the frame bodies PL2 and PR2 on the rear face of the inkjet printer 10, an upper plate PT that connects the upper ends of the side plates PL1 and PR1 and the frame bodies PL2 and PR2, etc.

A rail 15 is arranged (stretched) between the side plates PL1 and PR1, and a carriage 17 is arranged along the rail 15 in a freely movable manner in the left-right direction, that is, the main scanning direction. For that purpose, arranged in a freely rotatable manner are a drive-side pulley 18 on the side plate PL1 and a driven-side pulley 19 on the side plate PR1, an endless belt 21 is stretched in a freely travelable manner by the drive-side pulley 18 and the driven-side pulley 19, and the carriage 17 is attached to a prescribed place of the endless belt 21.

Inside the carriage 17, a plurality of (four in this embodiment) recording heads Hdi (i=1, 2, . . . , 4) mentioned below (FIG. 3) are arranged with their nozzle faces oriented downwards so as to allow forming at least one image. Also, a carriage motor 22 as a drive part for moving the carriage is arranged adjacent to the drive-side pulley 18. Also, an optical sensor 24 as an optical detection part is arranged on the side face in the side plate PL1 side of a housing Hs of the carriage 17.

In this embodiment, the recording heads Hdi eject inks of black, cyan, magenta, and yellow colors, respectively.

Each of the recording heads Hdi has a width of 2 inches and is provided with a nozzle array comprising 1024 nozzles in the sub scanning direction, and therefore can form up to 1024 dots with a pitch of about 49.6 μm.

By driving the above-mentioned carriage motor 22, the above-mentioned drive-side pulley 18 is rotated to have the endless belt 21 travel, thereby the carriage 17 is moved in the main scanning direction, and the recording heads Hdi are moved in the main scanning direction (±X directions, see FIG. 2).

A linear scale 23 is arranged extending along the above-mentioned rail 15 and in parallel to the rail 15, and a below-mentioned encoder 35 arranged on the carriage 17 reads graduations of the linear scale 23, thereby detecting the position of the carriage 17. A sensor output of the encoder 35 is A/D converted into a position signal, a carriage drive processing part Pr3 of a below-mentioned control part 80 (FIG. 1) reads the position signal, calculates the position and moving speed of the carriage 17, and moves the carriage 17.

At this time, according to the position of the carriage 17, color inks are ejected from the recording heads Hdi toward a recording medium P and adhere to the recording medium P, thereby forming an image such as a character or picture on the recording medium P.

In this manner, recording by the recording heads Hdi, that is, printing is performed.

Note that as the recording medium P, other than a sheet of paper, a film made of resin such as vinyl chloride or PET can be used.

Also, a platen 25 having a plate shape is arranged extending along the above-mentioned rail 15 and in parallel to the rail 15, that is, in the main scanning direction. The platen 25 extends between the frame bodies PL2 and PR2 on the above-mentioned receiving plate RB and supports the recording medium P carried on the platen 25.

Then, arranged under the above-mentioned platen 25 is an unshown air suction device for drawing the recording medium P toward the platen 25 with a negative pressure. The air suction device is formed over the entire area under the platen 25 and comprises a suction chamber, a suction fan, etc., and air above the platen 25 is sucked through a plurality of holes formed on the platen 25 by the suction fan, thereby the recording medium P is supported flat by the platen 25.

Also, arranged toward the back of the platen 25 is an unshown rear paper guide as a first medium guide part, and the rear paper guide guides the recording medium P fed out from an unshown feeding roll toward the platen 25. For that purpose, a carrying roller pair 30 as a carrying member is arranged in a freely rotatable manner between the above-mentioned rear paper guide and the platen 25.

The carrying roller pair 30 comprises a carrying roller 31 as a first roller arranged adjacent to the platen 25 in a freely rotatable manner extending in the main scanning direction of the inkjet printer 10, and pinch rollers 32 as second rollers that are arranged in a freely rotatable manner in a plurality of places with a prescribed pitch above the carrying roller 31 and press the recording medium P against the carrying roller 31. Once a below-mentioned carrying motor 34 as a carrying drive part is driven to rotate the carrying roller 31, the pinch rollers 32 are rotated following it.

Thereby, the recording medium P is fed out from the above-mentioned feeding roll in a state pinched by the carrying roller 31 and the pinch rollers 32, and sent toward the platen 25 on the above-mentioned rear paper guide. Then, while being carried on the platen 25, the recording medium P opposes the nozzle faces of the recording heads Hdi, and inks are ejected from the recording heads Hdi and adhere to the recording medium P.

In this case, printing is performed by a multi-pass method, where the carrying motor 34 is driven to carry the recording medium P by a prescribed distance, afterwards the carrying motor 34 is stopped, and the carriage 17 is moved in that state, inks are ejected from the recording heads Hdi, thereby one scan is performed, and this operation is repeated multiple times to perform multiple scans, thereby forming one line of an image.

Note that when printing by a single-pass method, the distance to carry the recording medium P mentioned above is set equal to the length of the nozzle array of the recording heads Hdi, and one line of an image is formed by performing one scan.

Also, arranged toward the front of the above-mentioned platen 25 is a front paper guide 33 as a second medium guide part for guiding and ejecting the recording medium P on which printing was performed. The front paper guide 33 has a curved shape for guiding downwards the recording medium P ejected in the horizontal direction from the above-mentioned platen 25.

Therefore, the recording medium P is guided by the above-mentioned rear paper guide and sent to the platen 25, on which printing is performed by having inks ejected from the recording heads Hdi adhere, afterwards is guided by the front paper guide 33 and sent to and wound up by the an unshown winding device arranged on the frame Fr.

Note that the rear paper guide, the platen 25, and the front paper guide 33 mentioned above each has an unshown heater as a heating member embedded, and the recording medium P is preheated by the rear paper guide and heated by the platen 25 and the front paper guide 33, thereby promoting drying of inks adhering to the recording medium P.

A home position is set between the above-mentioned side plate PL1 and the above-mentioned frame body PL2, a retreat position is set between the above-mentioned frame body PR2 and the above-mentioned side plate PR1, and the carriage 17 reciprocates between the home position and the retreat position.

Then, arranged in the above-mentioned home position is a cap unit 41 as a first maintenance device comprising a cap that covers the nozzle faces of the recording heads Hdi and prevents drying of inks, an ink receiver that receives inks having developed high viscosity in the nozzles, etc. Also, arranged in the above-mentioned retreat position is a wipe unit 42 as a second maintenance device provided with an unshown wiper that rubs the nozzle faces of the recording heads Hdi and removes dirt, inks, etc. adhering onto the nozzle faces in order to maintain the nozzles of the recording heads Hdi in a good state.

When forming an image on the recording medium P while reciprocating the carriage 17 as in the inkjet printer 10 in this embodiment, inks need to be ejected so that dots are superimposed on each other for the same pixel between the outbound travel (−X direction) that moves the carriage 17 from the home position side to the retreat position side and the inbound travel (+X direction) that moves the carriage 17 from the retreat position side to the home position side.

Then, in this embodiment, the image of a test pattern, that is, a pattern image is formed on the recording medium P, the pattern image is detected by the above-mentioned optical sensor 24, and based on a sensor output of the optical sensor 24 that is a result of detecting the pattern image, timings to eject inks from the recording heads Hdi in the outbound and inbound travels of the carriage 17 are adjusted.

However, when the recording surface of the recording medium P used has different reflection characteristics due to its forming materials, structure, etc., if the pattern image is formed on the boundary between mutually different reflection characteristics, the sensor output of the optical sensor 24 varies at the boundary of reflection characteristics, thereby the pattern image cannot be accurately detected.

Next, explained is a sensor output of the optical sensor 24 when a retroreflective medium is used as the recording medium P.

Figure 3:
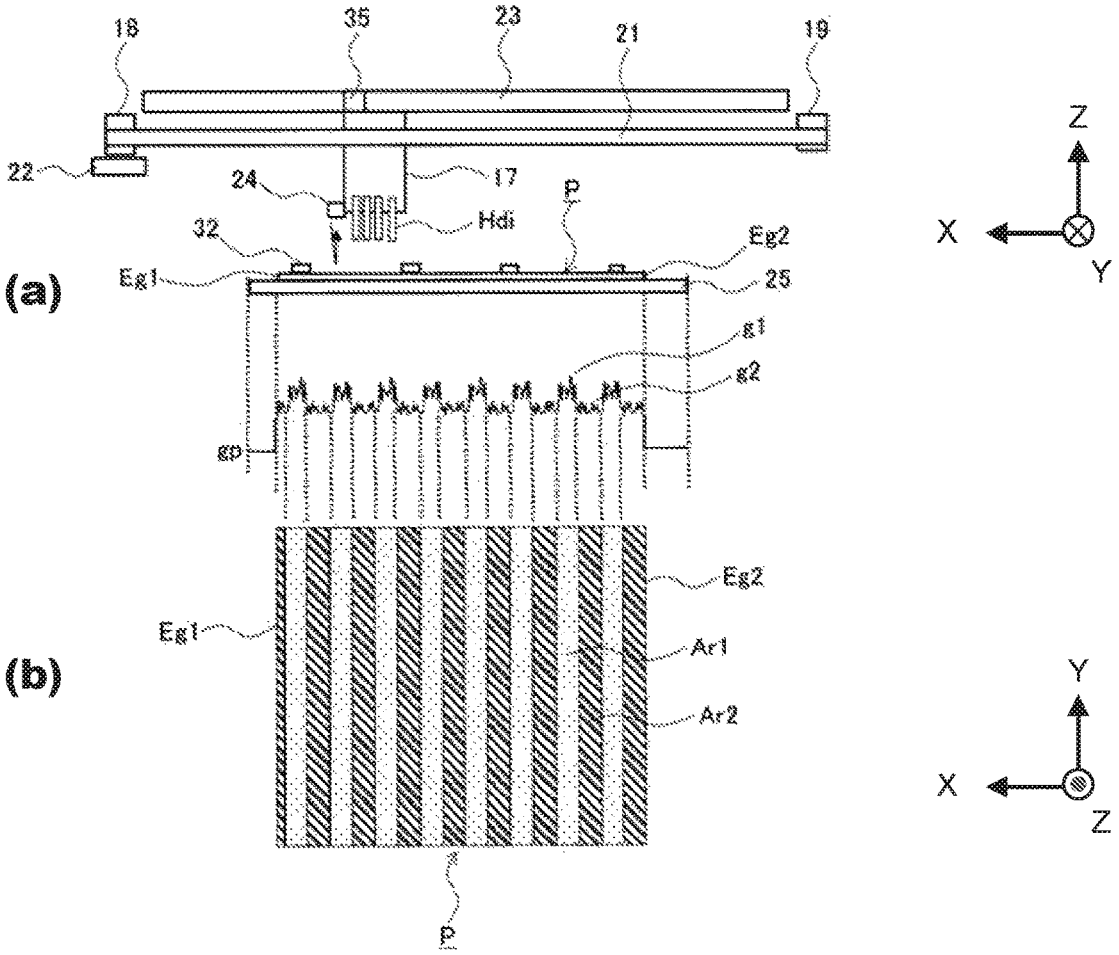
FIG. 3 is a diagram showing an example sensor output of the optical sensor when a retroreflective medium is used as a recording medium in the embodiment of this invention. (a) section shows the medium in +Y direction. (b) section shows the medium in −Z direction.

FIG. 3 is a diagram showing an example sensor output of the optical sensor when a retroreflective medium is used as a recording medium in the embodiment of this invention.

In the figure, indicated as P is the recording medium made of a retroreflective medium, Eg1 is a home position side edge of the recording medium P, Eg2 is a retreat position side edge of the recording medium P, 17 is the carriage, Hdi are 5h3 recording heads, 18 and 19 are the pulleys, 21 is the endless belt, 22 is the carriage motor, 23 is the linear scale, 24 is the optical sensor, 25 is the platen, 32 are the pinch rollers, and 35 is the encoder.

On the above-mentioned recording medium P, due to a difference in reflection characteristics between first and second prism layers Sp1 and Sp2 mentioned below (FIG. 9), band-shaped bright parts, that is, bright parts Ar1, extending in the sub scanning direction (Y direction) as a first region, and band-shaped dark parts, that is, dark parts Ar2, extending in the sub scanning direction as a second region are alternately formed in the main scanning direction.

Also, the above-mentioned optical sensor 24 is provided with a below-mentioned light emitting part 27 (FIG. 1) and a light receiving part 28, where the light emitting part 27 emits light toward the platen 25 side, and the light receiving part 28 receives reflected light and generates a detection voltage.

If the reflected light is reflection from the platen 25, the detection voltage of the light receiving part 28 becomes almost a uniform value gp. As opposed to this, if the reflected light is reflection from the recording medium P, the detection voltage of the light receiving part 28 slightly varies, taking a value of about g1 on the bright parts Ar1 and a value about g2 on the dark parts Ar2, where the gp, g1, and g2 values have a relationship of g1>g2>gp.

Once a pattern image is formed across the bright part(s) Ar1 and the dark part(s) Ar2 on the recording medium P made of a retroreflective medium, and the pattern image is detected by the optical sensor 24, because the bright part Ar1 and the dark part Ar2 have different reflection characteristics, the sensor output of the optical sensor 24 changes at the boundary of mutually different reflection characteristics, that is, the boundary between the bright part Ar1 and the dark part Ar2, thereby the pattern image cannot be accurately detected.

Then, in this embodiment, the position of the carriage 17 is detected by the encoder 35, the sensor output of the optical sensor 24 is acquired at every position of the carriage 17, a pattern image is formed in a position according to the reflection characteristics of the recording surface of the recording medium P, and the pattern image is detected.

Next, explained is a control device of the inkjet printer 10.

Figure 1:
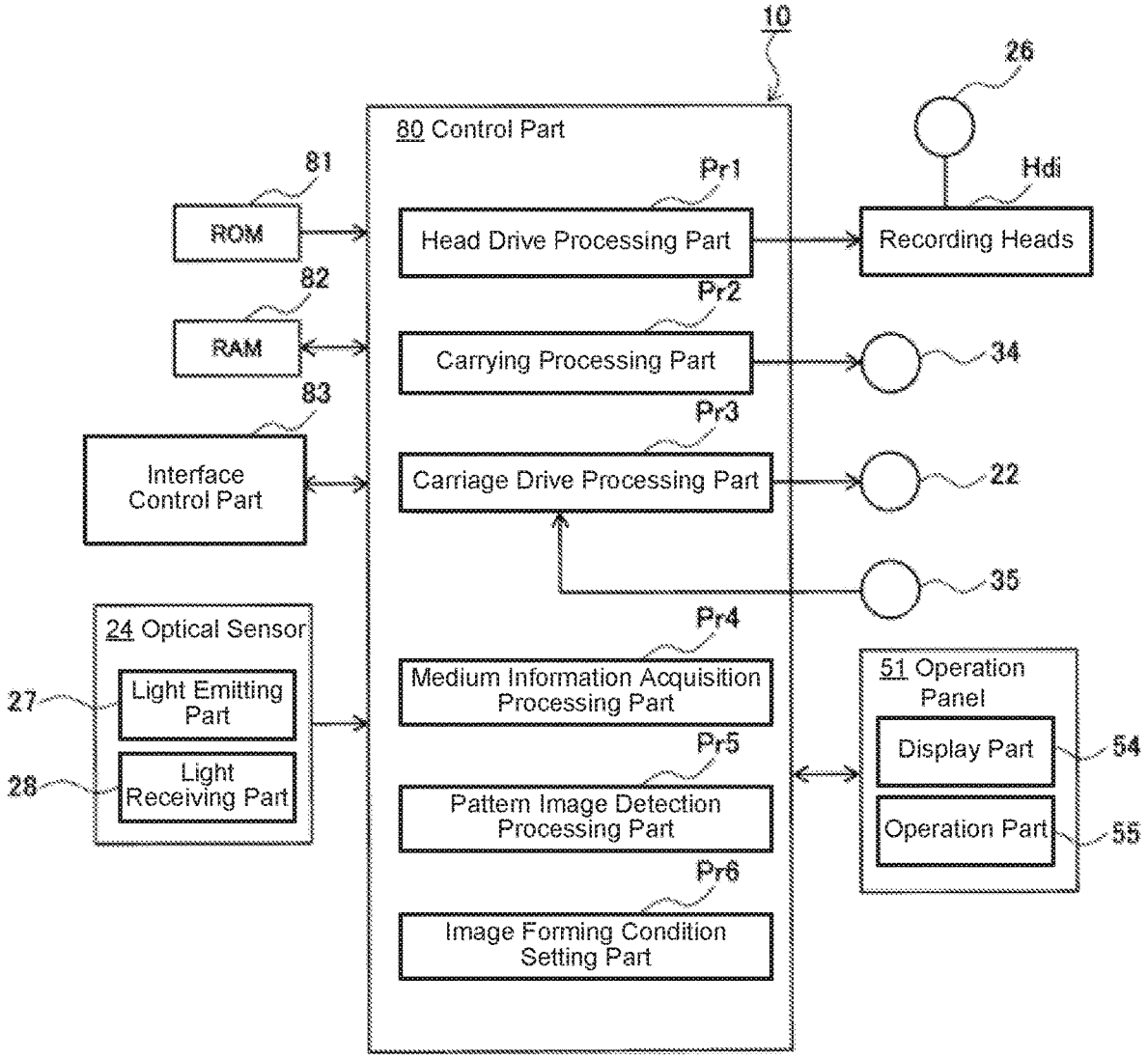
FIG. 1 is a control block diagram of an inkjet printer in an embodiment of this invention.

FIG. 1 is a control block diagram of the inkjet printer in the embodiment of this invention.

In the figure, indicated as 10 is the inkjet printer, 24 is the optical sensor, 51 is an operation panel, 80 is a control part that controls printing by controlling the whole sequence of the above-mentioned inkjet printer 10, 81 is ROM as a first memory part comprising nonvolatile memory, 82 is RAM as a second memory part comprising volatile memory, and 83 is an interface control part that receives print data from an unshown host computer as an upper-level device and an information processing device and records the data in the above-mentioned RAM 82. Although in this embodiment the print data are received via a USB cable, they can be received via a wireless LAN.

The above-mentioned optical sensor 24 is arranged on the side face in the side plate PL1 side of the housing Hs of the above-mentioned carriage 17 (FIG. 2), and is moved in the main scanning direction according to the movement of the carriage 17. The optical sensor 24 is provided with a light emitting part 27 comprising LEDs or the like, a light receiving part 28 comprising phototransistors or the like, and an unshown sensor driver. The light emitting part 27 emits light onto the recording medium P stopped on the above-mentioned platen 25 with a prescribed sampling cycle based on drive signals by the sensor driver, the light receiving part 28 receives reflected light, and analog detection signals generated at this time are A/D converted by the above-mentioned sensor driver to become detection voltages.

The above-mentioned operation panel 51 is provided with a display part 54 comprising an LED screen or the like for displaying the state of the inkjet printer 10, and an operation part 55 comprising switches, keys, etc. for the operator to input instructions to the inkjet printer 10. Note that if the operation panel 51 is formed of a touch panel, the operation panel 51 also functions as the operation part as well as the display part.

Then, the above-mentioned control part 80 is provided with a CPU as an arithmetic device, input/output ports, a timer, etc. that are not shown, and performs various processes based on a program recorded in the ROM 81.

In the ROM 81, other than the above-mentioned program, various types of initial setting values, image data of the pattern image, etc. are recorded. Also, in the RAM 82, other than image data that are generated based on the above-mentioned print data and for performing the normal printing, various types of control data are temporarily recorded. Note that the RAM 82 functions as a work area when the above-mentioned CPU performs arithmetic operations.

Also, the above-mentioned control part 80 is provided with a head drive processing part Pr1 as a pattern image formation processing part, a carrying processing part Pr2, the carriage drive processing part Pr3, a medium information acquisition processing part Pr4, a pattern image detection processing part Pry, an image forming condition setting part Pr6, etc.

Before printing is started, the above-mentioned head drive processing part Pr1 reads image data of the pattern image from the above-mentioned ROM 81, sends them to the recording heads Hdi, and drives the recording heads Hdi to form the pattern image on the recording medium P. Also, once printing is started, the above-mentioned head drive processing part Pr1 reads print data from the above-mentioned RAM 82, converts the print data to generate image data, sends the generated image data to the recording heads Hdi, and drives the recording heads Hdi to form an image on the recording medium P.

Note that arranged on the above-mentioned recording heads Hdi are piezo elements 26 as drive elements for the nozzles, respectively. Once a prescribed voltage is applied between unshown electrodes arranged at both ends of each of the piezo elements 26, the piezo elements 26 are driven to expand or contract according to the voltage, thereby deforming side walls of flow routes to send inks to the nozzles on the recording heads Hdi. Then, by the cross-sectional areas of the ink flow routes change according to the expansion or contraction of the piezo elements 26, inks by the same amounts as the changes in the cross-sectional areas of the ink flow routes are ejected from the nozzles as ink droplets.

The above-mentioned carrying processing part Pr2 sends a drive signal to the carrying motor 34, thereby driving the carrying motor 34, rotating the above-mentioned carrying roller pair 30 (FIG. 2), and carrying the recording medium P in the sub scanning direction.

The above-mentioned carriage drive processing part Pr3 drives the carriage motor 22 by a PWM control to have the above-mentioned endless belt 21 travel and the carriage 17 reciprocate in the main scanning direction.

For that purpose, the carriage drive processing part Pr3 reads a target position and a target speed of the carriage 17 from the ROM 81, reads a sensor output of the encoder 35 mentioned above, A/D converts the sensor output to calculate the position of the carriage 17, generates a PWM control signal as a control value, and sends it to the carriage motor 22. The carriage motor 22 receives the PWM control signal, changes the rotation speed in proportion to the duty of the PWM control signal, and moves the carriage 17 to the target position at the target speed by accelerating or decelerating it.

Also, the carriage drive processing part Pr3 sends the position of the carriage 17 to the head drive processing part Pr1, the head drive processing part Pr1 ejects inks from the recording heads Hdi at timings calculated based on the image data according to the position of the carriage 17.

In forming the pattern image on the recording medium P, the above-mentioned information acquisition processing part Pr4 detects the position of the recording medium P on the platen 25 and acquires the characteristics of the recording surface of the recording medium P.

The above-mentioned pattern image detection processing part Pr5 detects the pattern image formed on the recording medium P.

The above-mentioned image forming condition setting part Pr6 adjusts the timings to eject inks from the recording heads Hdi based on the detection result of the pattern image.

Next, explained is the above-mentioned pattern image. Note that because the timings to eject inks from the recording heads Hdi need to be individually adjusted, in this embodiment, pattern images of respective colors are formed for the recording heads Hdi.

Figure 4:
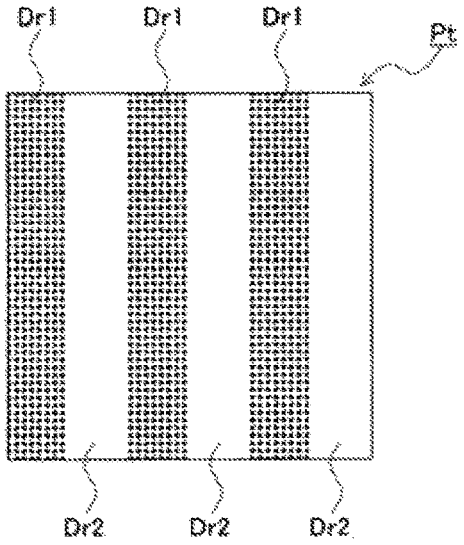
FIG. 4 is a diagram showing an example of a basic pattern image in the embodiment of this invention.
Figure 5:
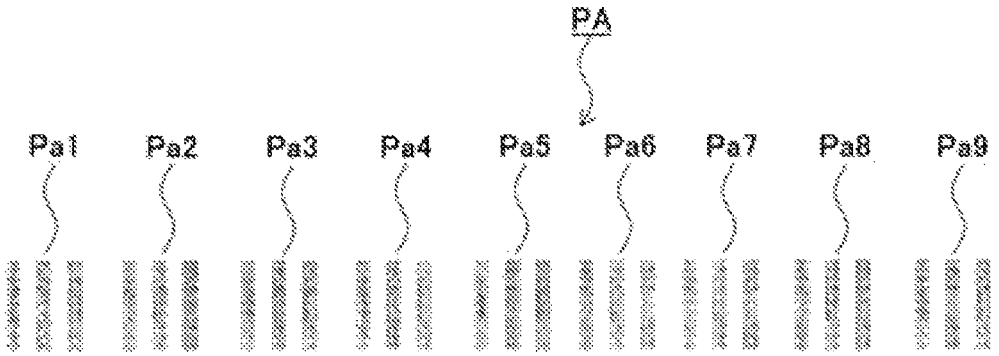
FIG. 5 is a diagram showing an example of a reference pattern image in the embodiment of this invention.
Figure 6:
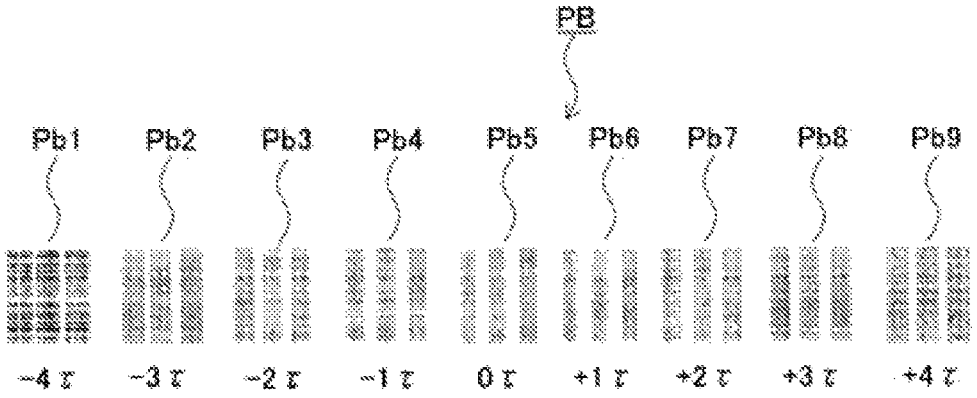
FIG. 6 is a diagram showing an example of a comparison pattern image in the embodiment of this invention.

FIG. 4 is a diagram showing an example of the basic pattern image in the embodiment of this invention, FIG. 5 is a diagram showing an example of the reference pattern image in the embodiment of this invention, and FIG. 6 is a diagram showing an example of the comparison pattern image in the embodiment of this invention.

In the figure, indicated as Pt is the basic pattern image comprising stripe-shaped patterns, PA is the reference pattern image as a first pattern image created based on the basic pattern image Pt, and PB is the comparison pattern image as a second pattern image created based on the reference pattern image PA.

The above-mentioned basic pattern image Pt comprises a plurality of (three in the figure) band-shaped image regions Dr1 formed by the recording heads Hdi (FIG. 3) ejecting inks from prescribed nozzles, and a plurality of (three in the figure) band-shaped non-image regions Dr2 formed by not ejecting any ink. The image regions Dr1 and the non-image regions Dr2 have widths of 10-20 mm and are arranged alternately adjacent to each other. The width of the recording medium in the main scanning direction (X) is 210 mm. The ratio of the width Dr1 and Dr2 per the width of the recording medium is ranged from about 4% to about 10%.

The above-mentioned image regions Dr1 are created by forming and arranging a plurality of (10-20 for example) dot arrays, each of which has a width of 0.5-1.5 mm and extends in the sub scanning direction, in the main scanning direction. Also, the non-image regions Dr2 are formed by forming dot arrays so as to have the same width as the width of the image regions Dr1 in the main scanning direction.

Note that various types of the above-mentioned basic pattern image Pt are created according to the situation of the inkjet printer 10, for example the types of the recording medium P used, and are recorded in the ROM 81.

Also, the reference pattern image PA consists of test patches Paj (j=1, 2, . . . , 9) formed in a plurality of places (9 places in this embodiment) in the main scanning direction, and the test patches Paj are formed by repeatedly forming the basic pattern image Pt in the outbound travel of the carriage 17.

Then, the comparison pattern image PB consists of test patches Pbj (j=1, 2, . . . , 9) formed in a plurality of places (9 places in this embodiment) in the main scanning direction, and the test patches Pbj are formed by forming the reference pattern image PA in the outbound travel of the carriage 17 and forming the basic pattern image Pt superimposed on the test patches Paj of the reference pattern image PA at slightly shifted printing timings.

For example, in the outbound travel of the carriage 17, the basic pattern image Pt is formed by ejecting inks at the first timing set as the initial value, forming a test patch Pa1, and in the inbound travel of the carriage 17, the basic pattern image Pt is formed superimposed on the test patch Pa1 by ejecting inks at the second timing delayed by time 4τ from the first timing, thereby forming a test patch Pb1.

In this embodiment, time τ is set as time for forming one dot by moving the carriage 17 in the main scanning direction. Therefore, the basic pattern image Pt formed at the first timing and the basic pattern Pt formed at the second timing are shifted by 4 dots to form the test patch Pb1.

In the same manner, in the inbound travel of the carriage 17, inks are ejected at the second timing that is later than the first timing by time 3τ, forming a test patch Pb2 with the basic pattern image Pt shifted by 3 dots, inks are ejected at the second timing that is later than the first timing by time 2τ, forming a test patch Pb3 with the basic pattern image Pt shifted by 2 dots, inks are ejected at the second timing that is later than the first timing by time 1τ, forming a test patch Pb4 with the basic pattern image Pt shifted by 1 dot, and inks are ejected at the second timing that is the same as the first timing, forming a test patch Pb5 with the same basic pattern image Pt.

Also, inks are ejected at the second timing that is earlier than the first timing by time 1τ, forming a test patch Pb6 with the basic pattern image Pt shifted by 1 dot, inks are ejected at the second timing that is earlier than the first timing by time 2τ, forming a test patch Pb7 with the basic pattern image Pt shifted by 2 dots, inks are ejected at the second timing that is earlier than the first timing by time 3τ, forming a test patch Pb8 with the basic pattern image Pt shifted by 3 dots, and inks are ejected at the second timing that is earlier than the first timing by time 4τ, forming a test patch Pb9 with the basic pattern image Pt shifted by 4 dots.

In this manner, in the comparison pattern image PB, by ejecting inks at the first and send timings when forming the test patch Pb6 comprising an image region Dr1 having the smallest width among the test patches Pbj, dots are formed in the same position between the outbound and inbound travels of the carriage 17.

Next, explained is the operation of the inkjet printer 10.

Figure 7:
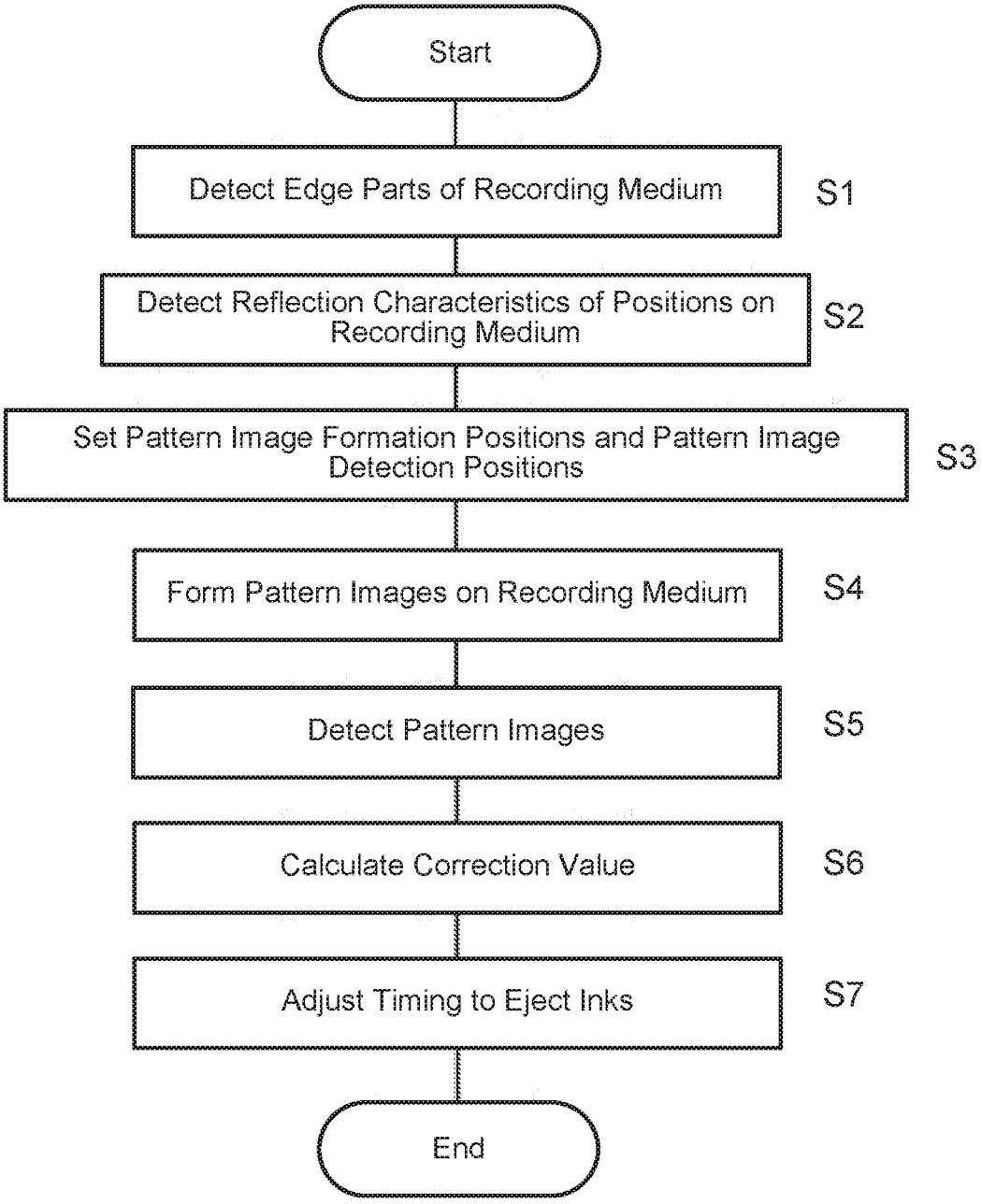
FIG. 7 is a flow chart showing the operation of the inkjet printer in the embodiment of this invention.
Figure 8:
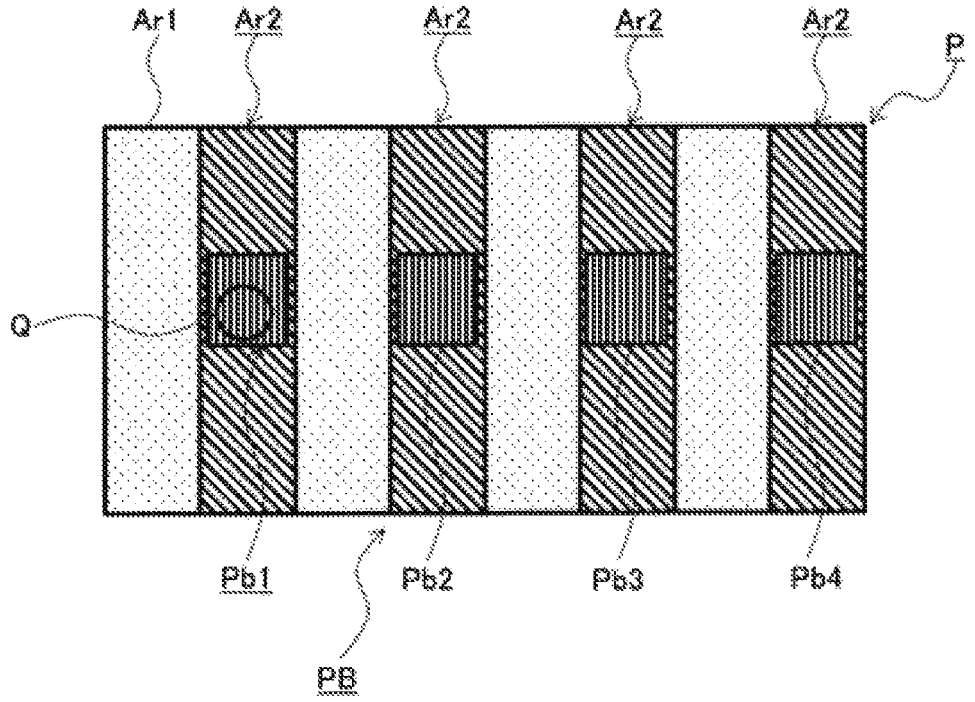
FIG. 8 is the first diagram for explaining pattern image formation positions and pattern image detection position in the embodiment of this invention.

FIG. 7 is a flow chart showing the operation of the inkjet printer in the embodiment of this invention, and FIG. 8 is the first diagram for explaining pattern image formation positions and a pattern image detection position in the embodiment of this invention.

First, the carrying processing part Pr2 (FIG. 1) drives the carrying motor 34 to feed out the recording medium P (FIG. 2) from the feeding roll, send it to the platen 25, and stop it on the platen 25.

Next, the medium information acquisition processing part Pr4 sends an instruction to the carriage drive processing part Pr3, thereby driving the carriage motor 22 to move the carriage 17 in its outbound travel from the home position side to the retreat position side, having the light emitting part 27 of the optical sensor 24 emit light toward the platen 25 side, reading the sensor output of the optical sensor 24, detecting the home position side edge Eg1 (FIG. 3) of the recording medium P in a position of the carriage 17 where the detection voltage of the light receiving part 28 changes from the value gp to the value g1 or g2, detecting the retreat position side edge Eg2 of the recording medium P in a position of the carriage 17 where the detection voltage changes from the value g1 or g2 to the value gp, calculating the width of the recording medium P, the position on the platen 25, etc. based on the positions of the edges Eg1 and Eg2, and recording them in the RAM 82. In one embodiment, a ratio of (g1/gp) is around 4/3. Further, the range may be ranged from 1.2 to 1.6, preferably from 1.3 to 1.4. A ratio of (g2/gp) is around 2/3. Further, the range may be ranged from 0.55 to 0.85, preferably from 0.65 to 0.75.

Next, the medium information acquisition processing part Pr4 sends an instruction to the carriage drive processing part Pr3 to move the carriage 17 in its inbound travel from the retreat position side to the home position side, and detects the reflection characteristic of each position on the recording surface of the recording medium P, for example at every dot pitch in the main scanning direction.

For that purpose, while moving the carriage, the medium information acquisition processing part Pr4 has the light emitting part 27 of the optical sensor 24 emit light toward the platen 25 side, reads the sensor output of the optical sensor 24 in each position on the recording surface, regards part where the detection voltage is the value g1 as the bright part Ar1, regards part where the detection voltage is g2 as the dark part Ar2, calculates the positions of the bright parts Ar1 and the dark parts Ar2, and records them in RAM 82.

Subsequently, the medium information acquisition processing part Pr4 sets positions where the pattern images are formed on the recording medium P, that is, the pattern image formation positions, and positions where the pattern images formed on the recording medium P are detected, that is, the pattern image detection position.

By the way, because the bright parts Ar1 and the dark parts Ar2 of the recording medium P have different reflection characteristics, the sensor output of the optical sensor 24 changes at boundaries between the bright parts Ar1 and the dark parts Ar2. Therefore, if a test patch Pbj is formed across the bright part Ar1 and the dark part Ar2, the pattern image cannot be accurately detected.

Then, the medium information acquisition processing part Pr4 reads the positions of the bright parts Ar1 and the dark parts Ar2 from the RAM 82, sets 9 dark parts Ar2 among the dark parts Ar2 as the pattern image formation positions for forming the test patches Pbj of the comparison pattern image PB expressing the pattern image, sets a region Q indicated as ○ in FIG. 8 for example, as the pattern image detection position among the dark parts Ar2 where the test patches Pbj of the comparison pattern image PB are formed, and records the pattern image formation positions and the pattern image detection position in the RAM 82.

Next, the head drive processing part Pr1 forms the pattern image on the recording medium P. For that purpose, the head drive processing part Pr1 sends an instruction to the carriage drive processing part Pr3, the carriage drive processing part Pr3 drives the carriage motor 22 to move the carriage 17 from the home position side to the retreat position side. Then, the head drive processing part Pr1 forms the basic pattern image Pt in the above-mentioned pattern image formation positions, that is, on the dark parts Ar2, in the outbound travel of the carriage 17, thereby forming the test patches Paj of the reference pattern image PA.

Also, the head drive processing part Pr1 sends an instruction to the carriage drive processing part Pr3, and the carriage drive processing part Pr3 drives the carriage motor 22 to move the carriage 17 from the retreat position side to the home position side. Then, the head drive processing part Pr1 forms the basic pattern image Pt superimposed on the test patches Paj formed on the above-mentioned dark parts Ar2 in the inbound travel of the carriage 17, thereby forming the test patches Pbj of the comparison pattern image PB. In this manner, the pattern image is formed on each of the dark parts Ar2.

Subsequently, the pattern image detection processing part Pr5 detects the pattern image formed on the recording medium P in each pattern image detection position. For that purpose, the pattern image detection processing part Pr5 sends an instruction to the carriage drive processing part Pr3 to move the carriage motor 22, thereby moving the carriage 17 from the home position side to the retreat position side, has the light emitting part 27 of the optical sensor 24 emit light to each of the test patches Pbj, reads the detection voltage generated by the light receiving part 28, and stores it in the RAM 82. In this case, light emitted by the light emitting part 27 to each of the test patches Pbj in each pattern image detection position consists of 5-10 light beams, and the light receiving part 28 generates the detection voltage for each of the light beams.

In this case, as shown in FIG. 6, by making the first timing to eject inks in the outbound travel and the second timing to eject inks in the inbound travel of the carriage 17 different, the test patches Pbj having mutually different image densities are formed. Then, the detection voltage generated by the light receiving part 28 for each of the test patches Pbj becomes high when the image density is low, and low when the image density is high.

Then, the image forming condition setting part Pr6 reads the detection voltages from the RAM 82, calculates the average value of the detection voltages for each of the test patches Pbj, and based on the first and second timings when the test patch Pbj having the highest average value is formed, a correction value ε for adjusting the timings to eject inks is calculated.

Among the test patches Pbj shown in FIG. 6, the test patch Pb6 has the lowest image density and the highest average value of the detection voltages, thereby the above-mentioned correction value ε becomes ε=+1τ.

Subsequently, the image forming condition setting part Pr6 records the correction value c in the RAM 82.

Therefore, when printing is performed afterwards, the image forming condition setting part Pr6 reads the correction value ε from the RAM 82 and sets the correction value ε as an image forming condition.

The head drive processing part Pr1 adjusts the timing to eject inks according to the correction value ε, making it earlier by time 1τ.

Next, explained is the flow chart.

S1: The medium information acquisition processing part Pr4 detects the edges Eg1 and Eg2 of the recording medium P.

S2: The medium information acquisition processing part Pr4 detects the reflection characteristics of positions on the recording medium P.

S3: The medium information acquisition processing part Pr4 sets the pattern image formation positions and the pattern image detection positions.

S4: The head drive processing part Pr1 forms the pattern images on the recording medium P.

S5: The pattern image detection processing part Pr5 detects the pattern images.

S6: The image forming condition setting part Pr6 calculates the correction value ε.

S7: The head drive processing part Pr1 adjusts the timing to eject inks and ends the process.

Next, explained is the reflection characteristics of the recording surface of the retroreflective medium used as the recording medium P.

Figure 9:
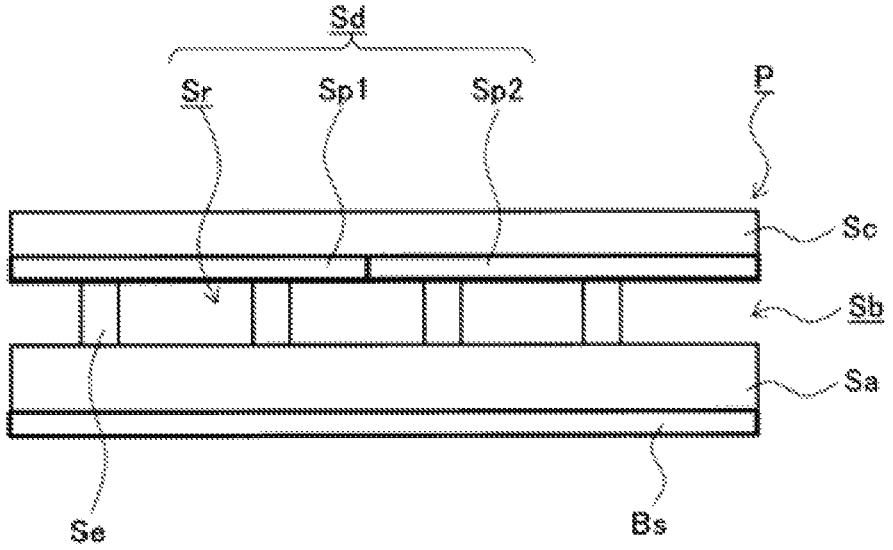
FIG. 9 is a cross-sectional view of the recording medium made of the retroreflective medium in the embodiment of this invention.

FIG. 9 is a cross-sectional view of the recording medium made of the retroreflective medium in the embodiment of this invention.

In the figure, indicated as P is the recording medium of the retroreflective medium, Bs is a supporting body, Sa is a base layer, Sb is an intermediate layer, and Sc is a film layer (surface layer).

Then, the above-mentioned intermediate layer Sb is provided with a reflective layer Sd formed of first and second prism layers Sp1 and Sp2 as refractive layers, and an air layer Sr, and a supporting layer (binding agent layer) Se that maintains the thickness of the above-mentioned air layer Sr and divide the air layer Sr.

When light is incident to part corresponding to the reflective layer Sd, light is refracted inside the first and second prism layers Sp1 and Sp2 and emitted in the opposite direction of the incident direction.

Parts of the above-mentioned reflective layer Sd corresponding to the first prism layer Sp1 and the second prism layer Sp2 have different reflection characteristics, that is, reflection angles by several to 15 degrees, thereby the bright parts Ar1 (FIG. 3) and the dark parts Ar2 are alternately formed.

Therefore, when forming the comparison pattern image PB (FIG. 6) extending in the main scanning direction on the recording medium P made of the retroreflective medium shown in the figure, the recording medium P is placed on the platen 25 so that the bright parts Ar1 and the dark parts Ar2 are alternatively arranged in the sub scanning direction.

As opposed to this, when the recording medium P is placed on the platen 25 so that the bright parts Ar1 and the dark parts Ar2 are alternatively arranged in the main scanning direction, the comparison pattern image PB (FIG. 6) needs to be formed extending in the sub scanning direction.

Note that while light incident to a part corresponding to the reflective layer Sd is emitted in the opposite direction of the incidence direction, light incident to a part corresponding to the above-mentioned supporting layer Se is specularly or diffusely reflected in the same manner as with the normal recording medium that is not a retroreflective medium, and its reflected light is emitted in every direction. Therefore, as shown in FIG. 3, although the sensor output of the optical sensor 24 slightly varies when the detection voltage takes values g1 or g2, there is no influence as large as forming the bright parts Ar1 and the dark parts Ar2 alternately.

In this manner, in this embodiment, the reflection characteristics of the recording surface of the recording medium P are acquired based on the sensor output of the optical sensor 24, the pattern image formation positions are set based on the reflection characteristics, and the pattern images are formed, therefore no pattern image is formed on the boundary of the reflection characteristics.

Therefore, because the sensor output of the optical sensor 24 never changes at the boundary of reflection characteristics, the pattern images can be accurately detected.

As a result, the timings to eject inks from the recording heads Hdi can be accurately adjusted, thereby the image quality can be improved.

When a retroreflective medium is used as the recording medium P, because light received by the light receiving part 28 contains light reflected by the pattern image formed on the recording medium P, and light that is transmitted by the pattern image, reflected by the reflective layer Sd inside the recording medium P, and is further transmitted by the pattern image, the sensor output of the optical sensor 24 is also influenced by light reflected by the reflective layer Sd.

However, because the pattern images are formed only on the dark parts Ar2, the pattern images can be accurately detected.

Also, in addition to the fact that the timings to eject inks can be adjusted, the carrying amount to carry the recording medium P by a certain distance can be adjusted.

In adjusting the carrying amount, the reference pattern image PA is formed on the recording medium P, and subsequently the recording medium P is carried to form the comparison pattern image PB. At this time, the test patches Pbj are formed by making their carrying amounts slightly changed. Afterwards, the comparison pattern image PB is detected by the optical sensor 24, and based on the carrying amount when a test patch having the lowest image density among the test patches Pbj, the carrying amount of the recording medium P in the sub scanning direction is adjusted.

Although in this embodiment, the pattern images are formed on the dark parts Ar2 of the recording medium P, the pattern images can also be formed on the bright parts Ar1.

Figure 10:
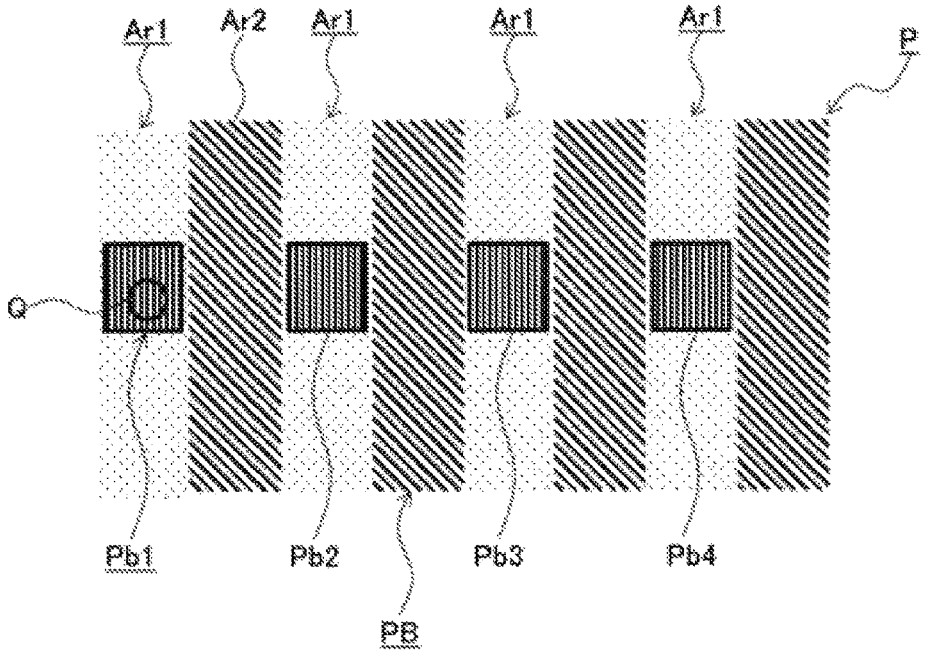
FIG. 10 is the second diagram for explaining the pattern image formation positions and the pattern image detection position in the embodiment of this invention.

FIG. 10 is the second diagram for explaining the pattern image formation positions and the pattern image detection position in the embodiment of this invention.

In the figure, indicated as P is the recording medium, Ar1 are the bright parts, Ar2 are the dark parts, PB is the comparison pattern image, Pb1-Pb4 are the test patches, and Q is a region where the pattern image detection position is set.

In this case, the medium information acquisition processing part Pr4 (FIG. 1) sets the pattern image formation positions on the bright parts Ar1, forms the test patches Pbj of the comparison pattern image PB on the bright parts Ar1, sets the region Q on each of the test patches Pbj, has the light emitting part 27 of the optical sensor 24 emit light to the region Q, and acquires the sensor output of the optical sensor 24.

Note that noise becomes easier to occur in the sensor output of the optical sensor 24 in the case where the pattern image formation positions are set on the bright parts Ar1 than in the case where the pattern image formation positions are set on the dark parts Ar2.

Next, explained is the case where the pattern image is formed across the bright part Ar1 and the dark part Ar2 of the recording medium P.

Figure 11:
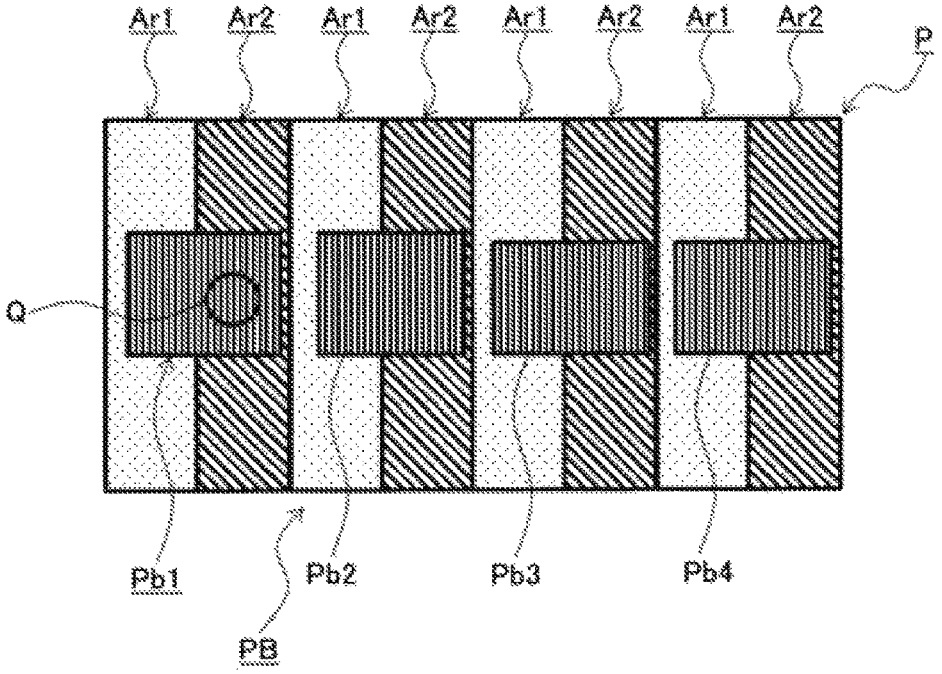
FIG. 11 is the third diagram for explaining the pattern image formation positions and the pattern image detection position in the embodiment of this invention.

FIG. 11 is the third diagram for explaining the pattern image formation positions and the pattern image detection position in the embodiment of this invention.

In the figure, indicated as P is the recording medium, Ar1 are bright parts, Ar2 are dark parts, PB is the comparison pattern image, Pb1-Pb4 are the test patches, Q is the region where the pattern image detection position is set.

In this case, the medium information acquisition processing part Pr4 (FIG. 1) sets the pattern image formation positions on the bright parts Ar1 and the dark parts Ar2, forms each of the test patches Pbj of the comparison pattern image PB across the bright part Ar1 and the dark part Ar2, sets the region Q on the dark part Ar2 of each of the test patches Pbj, has the light emitting part 27 of the optical sensor 24 emit light onto the region Q, and acquires the sensor output of the optical sensor 24.

Although in this case the region Q is set on the dark part Ar2 of each of the test patches Pbj, the region Q can also be set on the bright part Ar1 of each of the test patches Pbj.

Note that this invention is not limited to the above-mentioned embodiment, but various modifications can be made based on the purpose of this invention, and they are not excluded from the scope of this invention.

The invention is related to a correcting process of a timing to eject ink. It could be called a calibration, or a calibration process for ejecting ink. On the other hand, it may be called a normal printing, or normal print process for forming images on the recording media after the calibration process. The calibrations are to be periodically performed, or to be performed every time after a certain amount of prints is executed.

What is claimed is:

1. An image forming apparatus, comprising:

(a) recording heads that are mounted on a carriage, (b) an optical detection part that emits light onto a recording medium, receives reflected light that is the light reflected on a recording surface of the recording medium, and generates a sensor output in correspondence with the reflected light, (c) a medium information acquisition processing part that sets a pattern image formation position where a test pattern image is formed on the recording medium based on reflection characteristics of the recording surface of the recording medium, the reflection characteristics being obtained from the sensor output of the optical detection part, (d) a pattern image formation processing part that forms the test pattern image at the pattern image formation position using the recording heads, (e) a pattern image detection processing part that detects the test pattern image formed at the pattern image formation position using the optical detection part, generating a detection result, and (f) an image forming condition setting part that sets an image forming condition based on the detection result of the test pattern image by the pattern image detection processing part wherein first and second regions are alternately formed on the recording surface of the recording medium, a reflection characteristic of the first region is substantially uniform across the first region, a reflection characteristic of the second region is substantially uniform across the second region, the reflection characteristic of the first region is different from the reflection characteristic of the second region, and the medium information acquisition processing part sets the pattern image formation position within either the first region or the second region.

2. The image forming apparatus according to claim 1, wherein the carriage is configured to reciprocate in a main scanning direction, wherein the recording medium is carried to a sub scanning direction while being printed, which is perpendicular to the main scanning direction, the test pattern image comprises a plurality of test patches formed arranged in the main scanning direction with a predetermined space that is disposed between each two of the test patches adjacent one another, and each of the test patches is formed in the pattern image formation position set on the recording medium.

3. The image forming apparatus according to claim 1, wherein the carriage is configured to reciprocate between two sides on the recording medium, which are one side and the other side, along a main scanning direction, wherein an outbound way of the carriage is defined as a move from the one side to the other side in the main scanning direction, and an inbound move is defined as another way heading opposite to the outbound way, the pattern image formation processing part forms the test pattern image by causing the recording heads to eject inks at a first timing in the outbound way and at a second timing in the inbound way, the first and second timings are defined as time intervals between two continuous ink ejections, and the first timing is different from the second timing.

4. The image forming apparatus according to claim 1, wherein the image forming condition setting part calculates a correction value for adjusting a timing for the recording heads to eject inks based on the sensor output generated by the optical detection part when the optical detection part has detected the test pattern image and sets the correction value as the image forming condition.

5. The image forming apparatus according to claim 2, wherein band-shaped first and second regions having mutually different reflection characteristics are alternately formed on the recording surface of the recording medium, wherein the first and second regions are arranged parallel to the main scanning direction, and the medium information acquisition processing part sets the pattern image formation position in one of the first and second regions.

6. The image forming apparatus according to claim 5, wherein the medium information acquisition processing part sets the pattern image formation position at the second region if a detection voltage of the sensor output by reflected light when the optical detection part emitted light onto the first region is higher than a detection voltage of the sensor output by reflected light when the optical detection part emitted light onto the second region.

7. The image forming apparatus according to claim 2, wherein band-shaped first and second regions having mutually different reflection characteristics are alternately formed on the recording surface of the recording medium, wherein the band-shapes regions are arranged in parallel in one of the main scanning direction and the sub scanning direction, and the medium information acquisition processing part sets the pattern image formation position across the first and second regions, and sets a pattern image detection position that is designated to detect the test pattern image, the pattern image detection position is a partial area of the pattern image formation position and is located within only one of the first and second regions.

8. The image forming apparatus according to claim 1, wherein the carriage is configured to reciprocate in a main scanning direction, wherein the recording medium is carried to a sub scanning direction while being printed, which is perpendicular to the main scanning direction, the image forming apparatus further comprises:

a drive part that moves the carriage in the main scanning direction, and a carriage drive processing part that controls the movement of the carriage by controlling the drive part.

9. The image forming apparatus according to claim 1, wherein after the image forming condition setting part completes to set the image forming condition, which is defined as a corrected image forming condition, the image forming apparatus forms an image on the recording surface of the recoding medium with the recording heads using the corrected image forming condition.

10. The image forming apparatus according to claim 4, wherein the pattern image formation processing part that repeats to form the test pattern image at the pattern image formation position such that a plurality of the test pattern images are formed, the image forming condition setting part compares the test pattern images to select a representative test pattern wherein the representative test pattern has a larger gap between a high detection value and a low detection value than other test pattern images have, the high and low detection values being calculated from the reflection characteristics, the image forming condition setting part determines a timing in the representative test pattern as a correction value, after the image forming condition setting part determines the correction value, the image forming apparatus adjusts a timing to eject ink for forming an image on the recording surface of the recording medium by the correction value.

11. The image forming apparatus according to claim 1, wherein the pattern image formation position is a region of which the reflection characteristic is substantially uniform across the region.

12. The image forming apparatus according to claim 11, wherein the medium information acquisition processing part sets a pattern image detection position that is designated to detect the test pattern image, the pattern image detection position being substantially the same as or being located inside the pattern image formation position, and the pattern image detection processing part detects the test pattern image that is in the pattern image detection position.

13. The image forming apparatus according to claim 1, wherein the medium information acquisition processing part sets a pattern image detection position that is designated to detect the test pattern image, the pattern image detection position being substantially the same as or being located inside the pattern image formation position, and the pattern image detection processing part detects the test pattern image that is in the pattern image detection position.

* * * * *